US006659579B2

(12) United States Patent
Marquis

(10) Patent No.: US 6,659,579 B2
(45) Date of Patent: Dec. 9, 2003

(54) SYSTEM FOR CONTROLLING THE INK LEVEL IN FRANKING MACHINE

(75) Inventor: Karine Marquis, Paris (FR)

(73) Assignee: Neopost Industrie, Bagneux (FR)

( * ) Notice: Subject to any disclaimer, the term of this patent is extended or adjusted under 35 U.S.C. 154(b) by 29 days.

(21) Appl. No.: 10/008,477

(22) Filed: Dec. 10, 2001

(65) Prior Publication Data

US 2002/0070986 A1 Jun. 13, 2002

(30) Foreign Application Priority Data

Dec. 13, 2000 (FR) ..... 00 16200

(51) Int. Cl.[7] ..... B41J 2/195; B41J 29/38; B41J 29/393

(52) U.S. Cl. ..... 347/7; 347/5; 347/19

(58) Field of Search ..... 347/2, 5, 7, 14, 347/17, 19, 93

(56) References Cited

U.S. PATENT DOCUMENTS

| | | | | |
|---|---|---|---|---|
| 4,441,197 A | | 4/1984 | Baun et al. | |
| 5,390,594 A | | 2/1995 | Nobile et al. | |
| 5,651,103 A | | 7/1997 | Arsenault et al. | |
| 5,655,174 A | | 8/1997 | Hirst | |
| 6,024,429 A | * | 2/2000 | Coffy et al. | 347/7 |
| 6,027,200 A | | 2/2000 | Takahashi et al. | |

FOREIGN PATENT DOCUMENTS

| | | | |
|---|---|---|---|
| DE | 19754663 A1 | 6/1998 | |
| EP | 0 376 575 A2 | 7/1990 | |
| EP | 0 724 232 A2 | 7/1996 | |
| EP | 0 825 567 A1 | 2/1998 | |
| EP | 0825567 A1 * | 2/1998 | 347/7 |
| EP | 0 961 235 A2 | 12/1999 | |

* cited by examiner

*Primary Examiner*—Benjamin R. Fuller
*Assistant Examiner*—An H. Do
(74) *Attorney, Agent, or Firm*—Sughrue Mion, PLLC

(57) ABSTRACT

In a franking machine comprising a base and a disposable head provided with ink jet printing means, a method of printing postal indicia is proposed, comprising the following steps:

activating said disposable head in response to determined parameters of identification extracted from memory means of this head and recognized as valid by said base, sending towards said disposable head from said base franking data representative of postal indicia to be printed, comprising static data and dynamic data, calculating in said base the number of droplets to be projected in order to print the dynamic data and add this number to that corresponding to the printing of the static data, previously memorized in said memory means, to obtain a total number of droplets to be projected for printing said postal indicia, determining the volume of ink consumed corresponding to that total number of droplets to be projected and memorize this volume of consumed ink in said memory means, and calculating the remaining volume of ink in said ink reservoir by subtracting said volume of consumed ink from said nominal volume of ink.

12 Claims, 2 Drawing Sheets

SYSTEM FOR CONTROLLING THE INK LEVEL IN FRANKING MACHINE

FIELD OF THE INVENTION

The present invention relates exclusively to the domain of mail processing and more particularly to a system for controlling the level of ink in a franking machine of the ink jet type.

BACKGROUND OF THE INVENTION

In the specific domain of mail processing, the postal indicia is known to be a monetary value and the Postal Administrations see to it that the quality of print is sufficient to avoid any fraud on the amount of franking. Similarly, for the company using the franking machine, a mailpiece which has been returned due to defective indicia means a loss of the corresponding amount of franking, as this piece had been previously metered and can in no case be cancelled a posteriori.

Manufacturers of franking machines have thus sought a means for knowing with precision the ink consumed in such a machine in order to avoid launching prints of insufficient quality.

European Patent Application No. 0 881 079 proposes metering the drops of ink every time that a postal indicia is printed and, when the number thus obtained is higher than a previously set threshold corresponding to a minimum threshold of the ink reservoir of the franking machine, any subsequent printing is prohibited.

However, this system for controlling the level of ink in a franking machine lacks accuracy as, on the one hand, it essentially employs an average volume of ink corresponding to a typical postal indicia and, on the other hand, it does not take into account the fact that the volume of one drop of ink varies very substantially with the temperature attained at the level of the projection nozzles (of the order of 10 to 50%). As a result, this system might indicate the minimum level of ink attained, while the ink reservoir of the franking machine is still partially filled. Ink reservoirs which can still be used are therefore unnecessarily wasted.

U.S. Pat. No. 6,024,429 also proposes directly weighing the ink remaining in the reservoir, printing being prohibited if the weight obtained proves less than a predetermined value. Unfortunately, this solution, albeit simple, involves the user stopping the machine and removing the ink reservoir before weighing it and subsequently reassembling it if the limiting threshold is not yet attained.

It is an object of the present invention to overcome the drawbacks set forth hereinbefore, by proposing a system for controlling the level of ink in a franking machine which allows an automatic and sufficiently precise estimation of the volume remaining in its ink reservoir. A further object of the invention is to avoid dismantling the ink reservoir other than when it is to be discarded once it has been recognized as empty.

SUMMARY OF THE INVENTION

These objects are attained by a franking machine comprising:

- a disposable head provided with an ink reservoir having a nominal volume of ink and memory means,
- a base provided with means for controlling said head in order to:

- activate this head in response to determined parameters of identification extracted from said memory means and recognized as valid by said base,
  - send franking data representative of postal indicia to be printed comprising static data and dynamic data,
  - calculate the number of droplets to be projected in order to print the dynamic data and add this number to that corresponding to the printing of the static data, previously memorized in said memory means, in order to obtain a total number of droplets to be projected for printing said postal indicia,
  - determine the volume of ink consumed corresponding to this total number of droplets to be projected and memorize this volume of consumed ink in said memory means, and
  - calculate the volume of ink remaining in said ink reservoir by subtracting said volume of ink consumed from said nominal volume of ink.

With this particular structure, the ink consumed may thus be calculated precisely without requiring any dismantling of the head and without unnecessary loss of ink due to an average estimation of consumption.

The disposable head further comprises a temperature sensor and the total number of droplets to be projected for printing said postal indicia is corrected as a function of the measured temperature of projection of the ink.

The memory means comprise a memory of EEPROM type.

The control means preferably further comprise means for furnishing the user with warning signals when predetermined threshold memorized in said memory means are exceeded. These predetermined thresholds comprise a first threshold corresponding to a "full" ink reservoir with 100% of the nominal volume of ink, a second threshold corresponding to an ink reservoir "approaching end of life" with 20% of the nominal volume of ink, a third threshold corresponding to an ink reservoir "to be changed immediately" with only 5% of the nominal volume of ink, and fourth threshold corresponding to an "empty" ink reservoir with 0% of the nominal volume of ink.

The control means advantageously prohibit any fresh print when said third threshold at 5% is exceeded unless the user nonetheless continues printing.

The present invention also relates to the corresponding method for printing postal indicia in a franking machine comprising a base and a disposable head provided with ink jet printing means, characterized in that it comprises the following steps of:

- activating said disposable head in response to determined parameters of identification extracted from memory means of this head and recognized as valid by said base,
- sending towards said disposable head from said base franking data representative of postal indicia to be printed, comprising static data and dynamic data,
- calculating in said base the number of droplets to be projected in order to print the dynamic data and add this number to that corresponding to the printing of the static data, previously memorized in said memory means, to obtain a total number of droplets to be projected for printing said postal indicia,
- determining the volume of ink consumed corresponding to that total number of droplets to be projected and memorizing this volume of consumed ink in said memory means, and
- calculating the remaining volume of ink in said ink reservoir by subtracting said volume of consumed ink from said nominal volume of ink.

According to an advantageous embodiment, the step of calculating the total number of droplets to be projected comprises a step of correction of this number as a function of the temperature of projection of the ink measured by means of a temperature sensor. Similarly, this step of calculating the total number of droplets to be projected comprises a step of correction of this number as a function of the operations of maintenance of the head.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
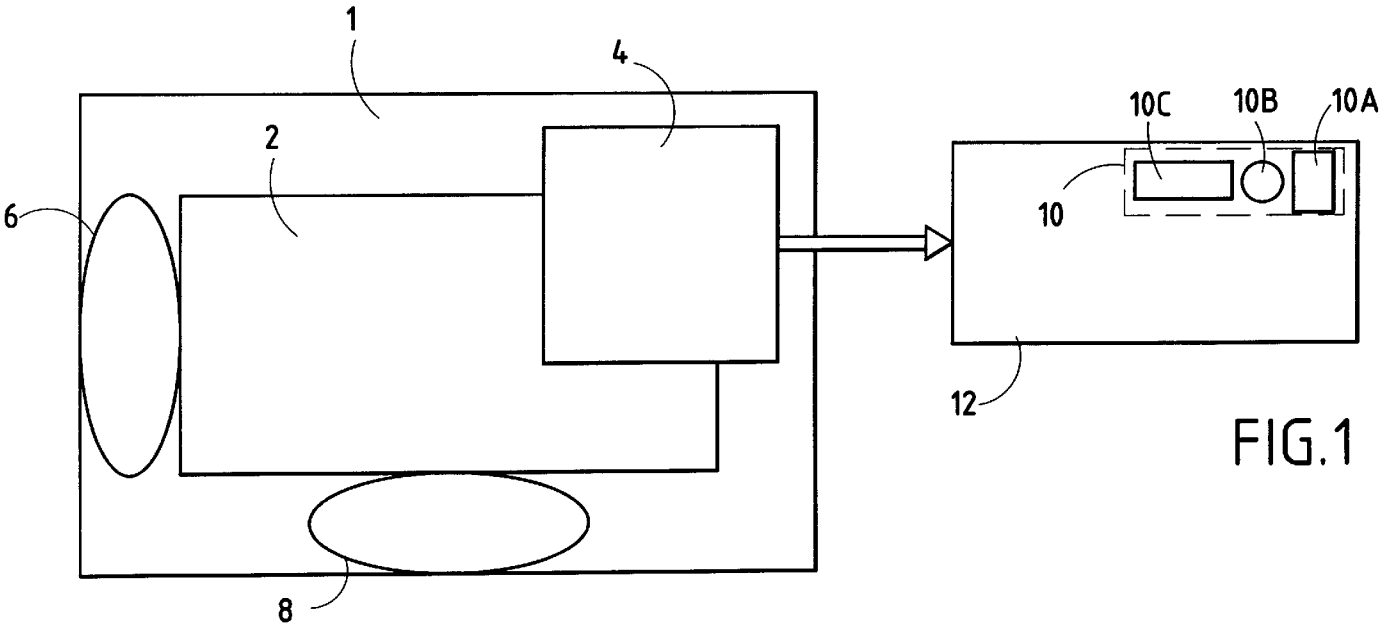
FIG. 1 is a diagram showing the different constituents of a franking machine.

Referring now to the drawings, FIG. 1 schematically illustrates a conventional architecture of a franking machine 1 of ink jet type. This machine comprises a base 2 and an ink jet printing head 4 of disposable type.

The disposable head 4 connected to the base by a preferably secured line comprises an ink reservoir, printing means (ink jet projection nozzles) and memory means for storing the parameters of identification and functioning of the head, in particular a country code, a serial number, a type and an ink colour used, a use-by date, an initial nominal volume of ink, etc . . .

The base 2 comprises in particular means for conveying mailpieces, means for metering the frankings (ascending and descending registers), means (by a man-machine interface 6) for selecting the types and values of franking, and possibly means 8 for reloading a franking credit from an outside server of the dealer of the machine or of the Postal Administration.

Figure 2:
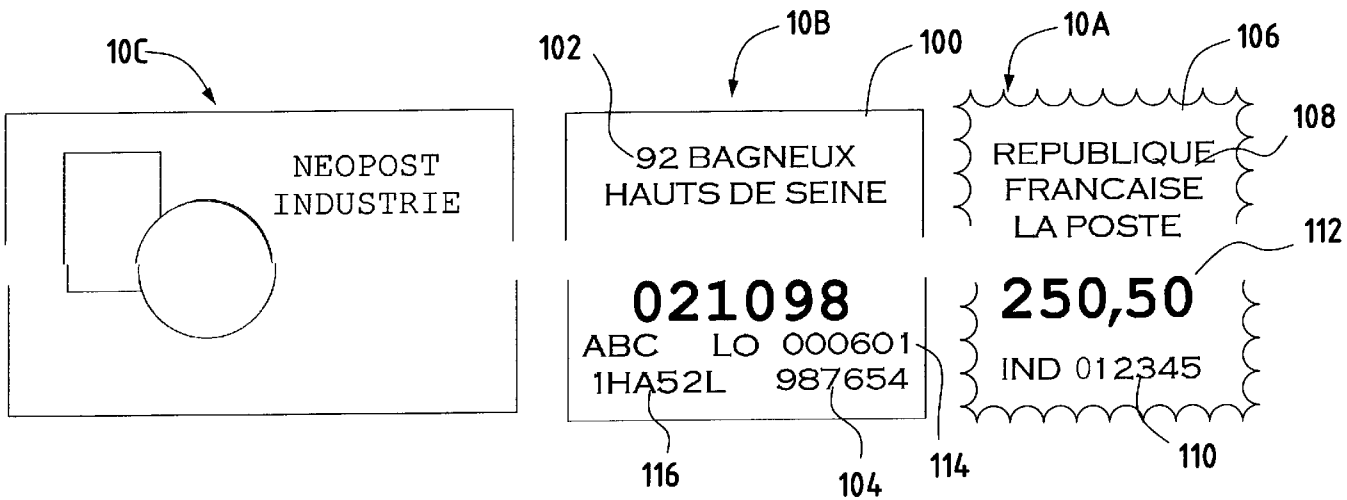
FIG. 2 shows secured postal indicia as may be printed by the franking machine of FIG. 1.

This franking machine allows the secured printing of postal indicia 10 on a mailpiece 12. The postal indicia illustrated in detail in FIG. 2 comprises at least one franking stamp 10A comprising an amount of franking, a date stamp 10B and a slogan (logo or advertizing slogan 10C).

Figure 3:
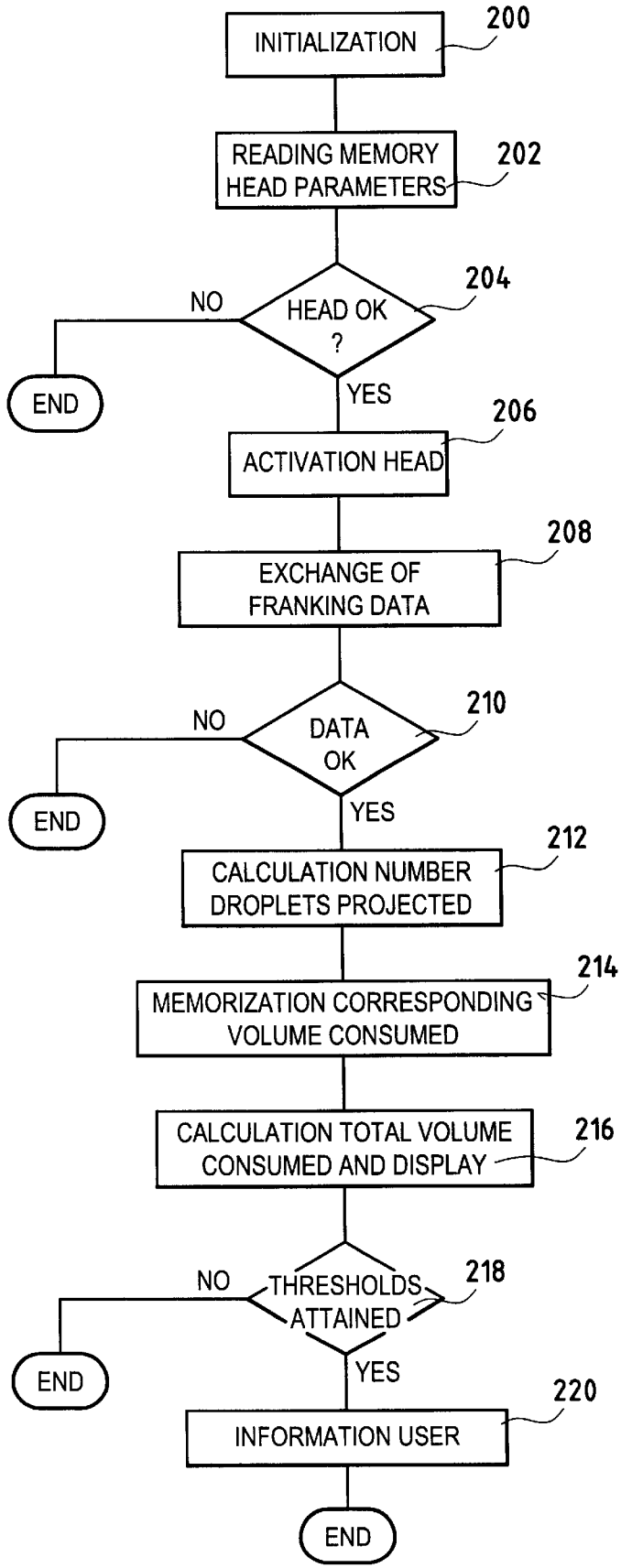
FIG. 3 is a flow chart illustrating the different steps for printing postal indicia.

The printing procedure carried out in this franking machine is schematically illustrated in FIG. 3. After a step of initialization 200, the contents of the memory means of the head 4 are read in a following step 202 from the base 2, in order to extract its parameters of identification. If, in a subsequent step 204, this reading allows the head mounted on the base to be validated (verification of the country code, the serial number, of the type of ink used, etc . . . and non-empty ink reservoir), a signal for activating this head, allowing unlocking thereof, is then sent from this base (step 206). Failing which the printing procedure cannot be initiated, as the head remains locked. On the contrary, by activating the head, an advantageously secured procedure of exchange of the franking data between base and head is launched in a step 208. After this exchange, if it takes place without error (verification of step 210), printing proper can then be initiated in accordance with the following scheme:

It is firstly proposed in a step 212 to calculate very exactly the number of droplets projected during printing of postal indicia (the result of this calculation being recorded in the memory means of the head, advantageously a memory of EEPROM type) and, from the determination of the average elementary volume of ink of these droplets as a function of the temperature noted at the level of the projection nozzles, by carrying out any known method, for example the one described in U.S. Pat. No. 5,036,337, to calculate the corresponding volume of ink consumed (step 214) then, by difference with the previously memorized volume of ink consumed (or the initial volume of ink for the first operation), to deduce therefrom the volume of ink remaining in the ink reservoir after every print (step 216). The number of droplets consumed during a particular operation connected with the maintenance of the head is, of course, also taken into account and, depending essentially on the nature of this operation, constitutes a constant value which is predetermined and previously memorized for each type of operation. The resulting residual volume is then compared in a step 218 with a plurality of thresholds memorized in the memory means of the head and to which the following states correspond:

- ink reservoir "full" with 100% of the nominal volume of ink,
- ink reservoir "approaching end of life" with 20% of the nominal volume of ink,
- ink reservoir "change immediately" with only 5% of the nominal volume of ink,
- ink reservoir "empty" with 0% of the nominal volume of ink.

These thresholds can only be modified in the factory, which ensures an irreversible evolution of the consumption and renders fraudulent filling of the ink reservoir useless. The user is informed by respective warning signals (preferably by means of a sound warning) each time that the threshold is exceeded, in an ultimate step 220.

Display of the consumption is preferably permanently ensured by pictograms representing for example an ink gauge provided with a colour code with, in particular, a green zone, an orange zone (reservoir approaching end of life) and a red zone (reservoir to be changed immediately). Such display, like that of the warning signals whenever a threshold is exceeded, is effected through the user interface 6 of the franking machine.

It should be noted that it is provided to stop the franking machine when the threshold of 5% is reached, but the user may nonetheless continue printing if he desires, but at his own risks. In that case, he must confirm his intention each time the franking machine is set into action, then whenever he launches printing of a fresh batch of mailpieces. When the last threshold is attained (empty reservoir), the head is automatically locked and only the positioning of a fresh reservoir can allow the franking machine to function again.

In order to calculate with accuracy the number of droplets projected during a printing, the franking data constituting the postal indicia 10 are broken down into "static data" and "dynamic data".

The static data are defined as those parts of the franking data which remain unchangeable during a determined printing cycle corresponding to the printing of a given batch of mailpieces. These are essentially the slogan 10C, the permanent parts of the date stamp 10B, essentially its outer frame design 100 and the invariable administrative legends such as the mention of the dispatching post office 102 or its identification number 104 for example, and the permanent parts of the franking stamp 10A, essentially its outer frame design 106, the official legend 108 (French Republic and The Post Office) and the postal identification number of the machine 110.

The dynamic data are defined as the complementary parts of the franking data which change during the printing cycle corresponding to the printing of the same given batch of mailpieces. These are essentially the code or codes for authentification of the indicia 114, 116 associated with the date stamp 108 and possibly also the amount of franking 112 contained in the franking stamp 10A (although a given batch generally receives the same franking).

In order to determine the number of droplets projected during the printing of postal indicia, the calculation of step 212 thus comprises two steps. Firstly, the exact calculation of the droplets projected is taken into account, based on the static data (this calculation is made during the construction of the head). Then a similar calculation is made on the dynamic data, this time as a function of the nature of each character printed in this zone, a determined number of droplets being associated with each character.

What is claimed is:

1. Franking machine comprising:

a disposable head provided with an ink reservoir having a nominal volume of ink and memory means, a base provided with means for controlling said head in order to:

activate this head in response to determined parameters of identification extracted from said memory means and recognized as valid by said base, send franking data representative of postal indicia to be printed comprising static data and dynamic data, calculate the number of droplets to be projected in order to print the dynamic data and add this number to that corresponding to the printing of the static data, previously memorized in said memory means, in order to obtain a total number of droplets to be projected for printing said postal indicia, determine the volume of ink consumed corresponding to this total number of droplets to be projected and memorize this volume of consumed ink in said memory means, and calculate the volume of ink remaining in said ink reservoir by subtracting said volume of ink consumed from said nominal volume of ink.

2. The franking machine of claim 1, wherein said disposable head further comprises a temperature sensor, and the total number of droplets to be projected for printing said postal indicia is corrected as a function of the measured temperature of projection of the ink.

3. The franking machine of claim 1, wherein said memory means comprise a memory of EEPROM type.

4. The franking machine of claim 1, wherein said control means further comprise means for furnishing the user with warning signals when predetermined thresholds memorized in said memory means are exceeded.

5. The franking machine of claim 4, wherein said predetermined thresholds comprise a first threshold corresponding to a "full" ink reservoir with 100% of the nominal volume of ink, a second threshold corresponding to an ink reservoir "approaching end of life" with 20% of the nominal volume of ink, a third threshold corresponding to an ink reservoir "to be changed immediately" with only 5% of the nominal volume of ink, and fourth threshold corresponding to an "empty" ink reservoir with 0% of the nominal volume of ink.

6. The franking machine of claim 5, wherein said control means prohibit any fresh print when said third threshold at 5% is exceeded, unless the user nonetheless continues printing.

7. The franking machine of claim 5, wherein said control means prohibit any fresh print when said fourth threshold at 0% is exceeded.

8. Method of printing postal indicia in a franking machine comprising a base and a disposable head provided with ink jet printing means, wherein it comprises the following steps of:

activating said disposable head in response to determined parameters of identification extracted from memory means of this head and recognized as valid by said base, sending towards said disposable head from said base franking data representative of postal indicia to be printed, comprising static data and dynamic data, calculating in said base the number of droplets to be projected in order to print the dynamic data and add this number to that corresponding to the printing of the static data, previously memorized in said memory means, to obtain a total number of droplets to be projected for printing said postal indicia, determining the volume of ink consumed corresponding to that total number of droplets to be projected and memorizing this volume of consumed ink in said memory means, and calculating the remaining volume of ink in said ink reservoir by subtracting said volume of consumed ink from said nominal volume of ink.

9. The method of printing of claim 8, wherein said step of calculating the total number of droplets to be projected comprises a step of correction of this number as a function of the temperature of projection of the ink measured by means of a temperature sensor.

10. The method of printing of claim 8, wherein said step of calculating the total number of droplets to be projected comprises a step of correction of this number as a function of the operations of maintenance of said head.

11. The method of printing of claim 8, wherein it further comprises a step consisting in delivering to the user warning signals when predetermined thresholds memorized in said memory means have been exceeded.

12. The method of printing of claim 11, wherein said step of delivering warning signals comprises the delivery of a first signal when a first threshold corresponding to a "full" ink reservoir with 100% of the nominal ink volume is exceeded, a second signal when a second threshold corresponding to an ink reservoir "approaching end of life" with 20% of the nominal volume of ink is exceeded, a third signal when a third threshold corresponding to an ink reservoir "to be changed immediately" with only 5% of the nominal volume of ink is exceeded, and a fourth signal when a fourth threshold corresponding to an "empty" ink reservoir with 0% of the nominal volume of ink is exceeded.

* * * * *